US009605553B2

(12) United States Patent
Hafner

(10) Patent No.: US 9,605,553 B2
(45) Date of Patent: Mar. 28, 2017

(54) TURBINE SEAL SYSTEM AND METHOD

(71) Applicant: General Electric Company, Schenectady, NY (US)

(72) Inventor: Matthew Troy Hafner, Greenville, SC (US)

(73) Assignee: General Electric Company, Schenectady, NY (US)

( * ) Notice: Subject to any disclaimer, the term of this patent is extended or adjusted under 35 U.S.C. 154(b) by 853 days.

(21) Appl. No.: 13/937,121

(22) Filed: Jul. 8, 2013

(65) Prior Publication Data

US 2015/0010384 A1 Jan. 8, 2015

(51) Int. Cl.
*F01D 11/00* (2006.01)
*F01D 5/30* (2006.01)

(52) U.S. Cl.
CPC ..... *F01D 11/008* (2013.01); *F01D 5/3015* (2013.01); *F05D 2230/60* (2013.01); *F05D 2240/55* (2013.01); *Y10T 29/49245* (2015.01)

(58) Field of Classification Search
CPC .... F01D 11/001; F01D 11/005; F01D 11/006; F01D 11/008; F01D 11/003; F01D 5/3015; F05D 2240/55; F05D 2230/60; Y10T 29/49245; Y10T 29/4932; B23P 6/002
See application file for complete search history.

(56) References Cited

U.S. PATENT DOCUMENTS

| | | | | |
|---|---|---|---|---|
| 3,295,825 | A | 1/1967 | Hall, Jr. | |
| 3,814,539 | A * | 6/1974 | Klompas | F01D 5/081 415/115 |
| 4,088,422 | A * | 5/1978 | Martin | F01D 5/06 415/173.7 |
| 4,582,467 | A | 4/1986 | Kisling | |
| 4,884,950 | A | 12/1989 | Brodell et al. | |
| 6,398,488 | B1 * | 6/2002 | Solda | F01D 5/081 415/115 |
| 7,220,099 | B2 | 5/2007 | Bekrenev et al. | |
| 2010/0074732 | A1 * | 3/2010 | Marra | F01D 5/025 415/173.4 |
| 2012/0003079 | A1 | 1/2012 | Farrell et al. | |

* cited by examiner

*Primary Examiner* — Craig Kim
*Assistant Examiner* — Brian P Wolcott
(74) *Attorney, Agent, or Firm* — Fletcher Yoder, P.C.

(57) ABSTRACT

A system includes a multi-stage turbine. The multi-stage turbine includes a first turbine stage with a first wheel having a plurality of first blade segments spaced circumferentially about the first wheel, a second turbine stage with a second wheel having a plurality of second blade segments spaced circumferentially about the second wheel, and an interstage seal assembly extending axially between the first and second turbine stages. The interstage seal assembly includes a first coverplate coupled to the first turbine stage. The first coverplate includes a first seal. The interstage seal assembly also includes a second coverplate coupled to the second turbine stage. The second coverplate includes a second seal. The interstage seal assembly also includes a spacer wheel extending from a rotor shaft and configured to engage with the first coverplate and the second coverplate.

24 Claims, 6 Drawing Sheets

TURBINE SEAL SYSTEM AND METHOD

BACKGROUND

The subject matter disclosed herein relates to gas turbines, and more specifically, to seals within turbines.

In general, gas turbine engines combust a mixture of compressed air and fuel to produce hot combustion gases. The combustion gases may flow through one or more turbine stages to generate power for a load and/or compressor. The combination of hot gases and high pressures can cause stress and wear of components in the turbine. To reduce the stress and wear, cooling gases flow through parts of the turbine, such as the sections between wheels, or the interior of turbine blades. Between each stage, a pressure drop may allow some leakage of the combustion gases to sections designated for cooling gases, or the cooling gases may leak into sections designated for combustion gases. Fluid leakage can reduce the efficiency of the turbine, reduce uniformity between turbines (which can cause uncertainty in a service schedule), or can allow wear of the turbine components, among other problems. Seal assemblies may be disposed between the stages to reduce fluid leakage between stages. Unfortunately, the seals may be subject to stresses, such as thermal stresses, which may bias the seals in axial and/or radial directions, thereby reducing effectiveness of the seals. To reduce the stresses on the seal assemblies, the assemblies may be placed away from the path of the combustion gases. This arrangement, however, may cause additional leakage between the seal assembly and a nozzle that is used to direct the combustion gases. Furthermore, the seal assemblies may extend the distance between turbine stages, which can cause an increase in the overall cost of the turbine.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a multi-stage turbine having a first turbine stage with a first wheel having a plurality of first blade segments spaced circumferentially about the first wheel, a second turbine stage with a second wheel having a plurality of second blade segments spaced circumferentially about the second wheel, and an interstage seal assembly extending axially between the first and second turbine stages. The interstage seal assembly includes a first coverplate coupled to the first turbine stage. The first coverplate includes a first seal. The interstage seal assembly also includes a second coverplate coupled to the second turbine stage. The second coverplate includes a second seal. The interstage seal assembly also includes a spacer wheel extending from a rotor shaft and configured to engage with the first coverplate and the second coverplate.

In a second embodiment, a method of installing an interstage seal assembly between a first turbine stage and a second turbine stage of a multi-stage turbine includes installing a first coverplate into a first wheel of the first turbine stage, installing a first blade segment around a first circumferential rim of the first wheel. The first blade segment is configured to secure the first coverplate. The method also includes installing a spacer wheel and a second coverplate.

The spacer wheel is installed between the first coverplate and the second coverplate and is configured to support the first coverplate and the second coverplate. The method also includes installing a second blade segment around a second circumferential rim of the second wheel.

In a third embodiment, an interstage seal assembly for a gas turbine, includes a first coverplate configured to be coupled to a first turbine stage of a multi-stage turbine. The first coverplate includes a first seal. The interstage assembly also includes a second coverplate configured to be coupled to a second turbine stage of the multi-stage turbine. The second coverplate includes a second seal. The interstage seal assembly also includes a spacer wheel configured to extend from a rotor shaft of the multi-stage turbine and configured to engage with the first coverplate and the second coverplate.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
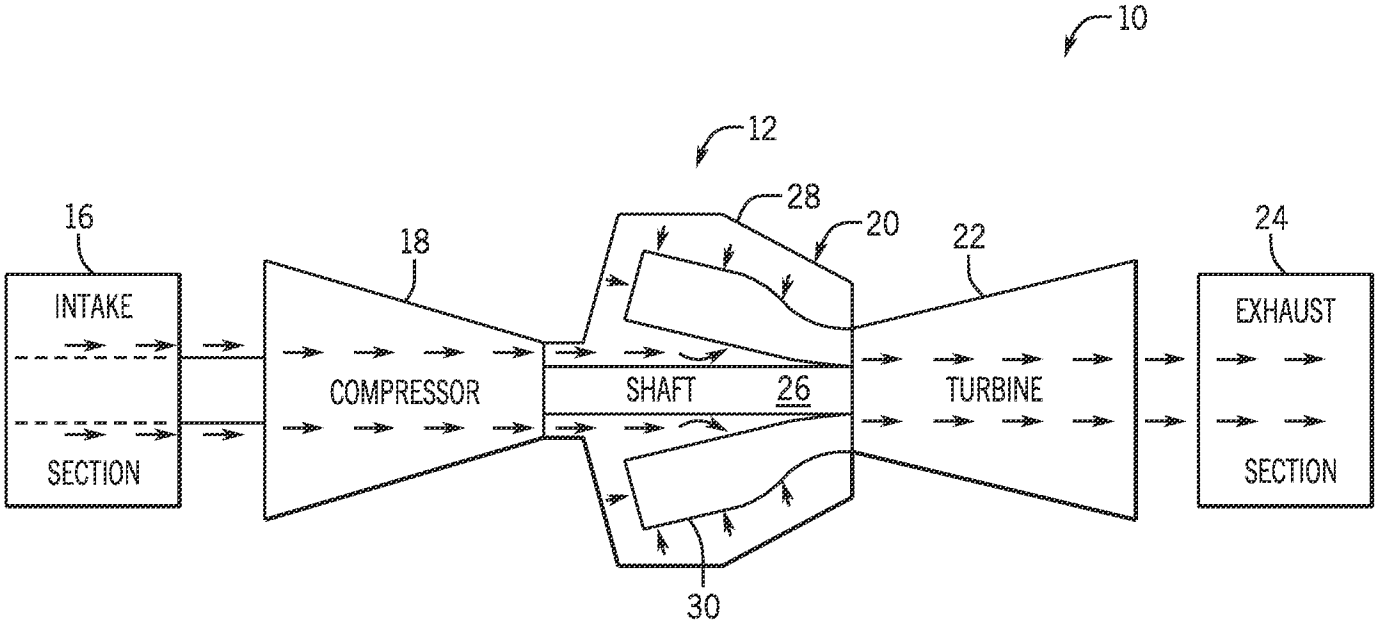
FIG. 1 is a schematic flow diagram of an embodiment of a gas turbine engine that may employ turbine seals.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to gas turbine engines that include interstage seal assemblies, wherein each interstage seal assembly includes seals that are separated from a blade segment of a turbine stage. The separation of the seal from the blade segments may enable the turbine stages to fit closer together in the gas turbine engine. Thus, gas turbine engines that include such interstage seal assemblies may be less costly than engines using other blade segments or seal assemblies. For example, the gas turbine engine may include a first turbine stage that includes a first wheel that has a plurality of first blade segments spaced circumferentially about the first wheel, and a second turbine stage that includes a second wheel having a plurality of second blade segments spaced circumferentially about the second wheel. The interstage seal assembly may extend axially between the first and second turbine stages to seal an interstage gap between the first and second stages. In addition, embodiments of the interstage seal may be installed and removed without disassembling a rotor of the gas turbine engine. For example, the interstage seal assembly may be configured to be installed or removed while the first and second wheels remain in place in the respective first and second turbine stages. Thus, if only the interstage seal assembly is replaced, the rotor of the gas turbine engine is not disturbed, thereby potentially reducing maintenance time, complexity, and/or cost. In some embodiments, the interstage seal assembly may include one or more coverplates configured to enable the interstage seal assembly to be installed in multiple steps or stages. The coverplate may include a seal, such as an angel wing or curved wing, which directs combustion gases, or other fluids, in a desired direction. In contrast to positioning the seal on the blade segment, the disclosed embodiments separate the seal from the blade segment and move the seal to the coverplate to enable the seal to be placed under the blade segment, which shortens the distance used to slide the blade segment out of the wheel during servicing operations. Shortening this distance enables the turbine stages to be closer together, which also shortens the overall length of the gas turbine. Additionally, the coverplate may include a sealing element, different from the seal, which blocks cooling gases from escaping the cooling paths within the gas turbine.

FIG. 1 is a block diagram of an exemplary system 10 including a gas turbine engine 12 that may employ interstage seal assemblies configured to be installed or removed without rotor disassembly, as described in detail below. In certain embodiments, the system 10 may include an aircraft, a watercraft, a locomotive, a power generation system, or combinations thereof. The illustrated gas turbine engine 12 includes an air intake section 16, a compressor 18, a combustor section 20, a turbine 22, and an exhaust section 24. The turbine 22 is coupled to the compressor 18 via a shaft 26.

As indicated by the arrows, air may enter the gas turbine engine 12 through the intake section 16 and flow into the compressor 18, which compresses the air prior to entry into the combustor section 20. The illustrated combustor section 20 includes a combustor housing 28 disposed concentrically or annularly about the shaft 26 between the compressor 18 and the turbine 22. The compressed air from the compressor 18 enters combustors 30, where the compressed air may mix and combust with fuel within the combustors 30 to drive the turbine 22.

From the combustor section 20, the hot combustion gases flow through the turbine 22, driving the compressor 18 via the shaft 26. For example, the combustion gases may apply motive forces to turbine rotor blades within the turbine 22 to rotate the shaft 26. After flowing through the turbine 22, the hot combustion gases may exit the gas turbine engine 12 through the exhaust section 24. As discussed below, the turbine 22 may include a plurality of interstage seal assemblies, which may be installed or removed while rotary components of the turbine 22, such as wheels, remain in place. Thus, maintenance affecting the interstage seal assemblies may be performed without complete disassembly of the turbine 22.

Figure 2:
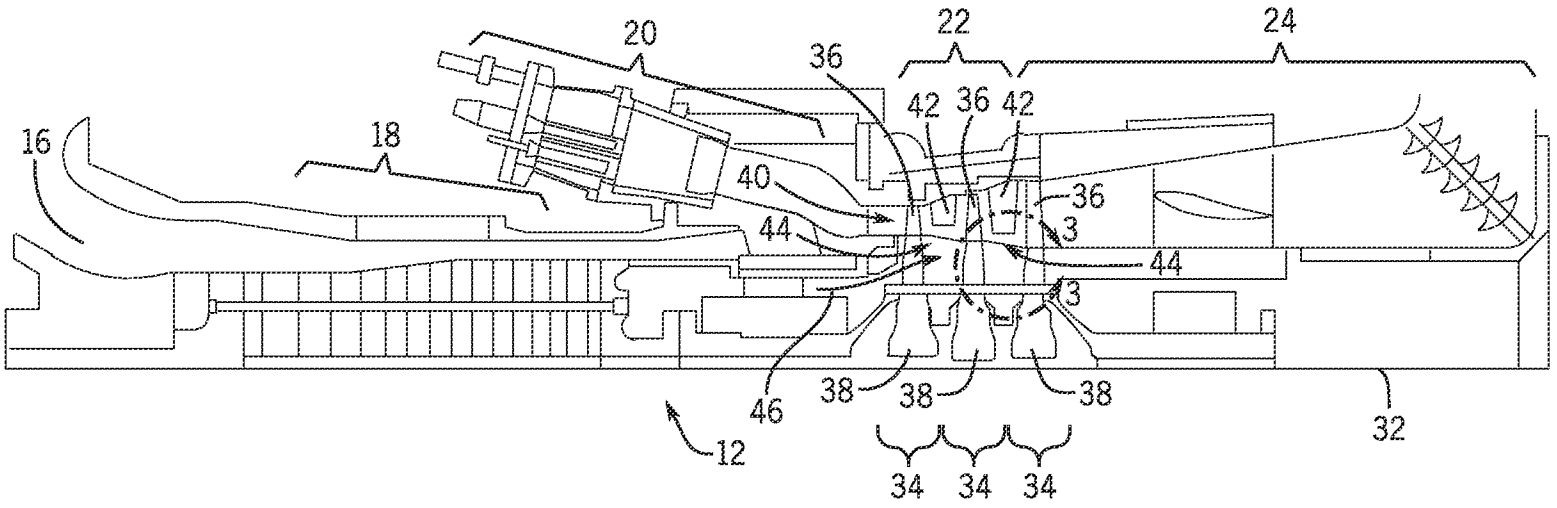
FIG. 2 is a cross-sectional side view of an embodiment of the gas turbine engine of FIG. 1 taken along the longitudinal axis.

FIG. 2 is a cross-sectional side view of an embodiment of the gas turbine engine 12 of FIG. 1 taken along the longitudinal axis 32. As depicted, the gas turbine 22 includes three separate stages 34. Each stage 34 includes a set of blades 36 coupled to a rotor wheel 38 that may be rotatably attached to the shaft 26 (FIG. 1). The blades 36 extend radially outward from the rotor wheels 38 and are partially disposed within the path of the hot combustion gases 40. The combustion gases 40 also flow through stationary nozzles 42 (e.g., stationary blades) that direct the combustion gases 40 against the blades 36, so that the blades 36 may drive the rotor 26 more effectively. Seal assemblies 44 extend between adjacent rotor wheels 38. As discussed below, the seal assemblies 44 may include coverplates that fit about adjacent wheels 38 for support. The coverplates may be configured to block the flow of a cooling fluid 46 that flows along a path on the radially inner side (i.e., closer to the longitudinal axis 32) of the seal assemblies 44. The cooling fluid 46, in some embodiments, may also flow through cooling paths within the blades 36. The interstage seal assemblies 44 may be installed or removed, with the coverplates, while the rotor wheels 38 remain in place in the gas turbine engine 12. Although the gas turbine 22 is illustrated as a three-stage turbine, the seal assemblies 44 described herein may be employed in any suitable type of turbine with multiple stages and shafts. For example, the seal assemblies 44 may be included in a two stage gas turbine, in a dual turbine system that includes a low-pressure turbine and a high-pressure turbine, or in a steam turbine. Further, the seal assemblies 44 described herein may also be employed in an axial compressor, such as the compressor 18 illustrated in FIG. 1. The seal assemblies 44 may be made from various high-temperature alloys, such as, but not limited to, nickel based alloys.

As described above with respect to FIG. 1, air enters through the air intake section 16 and is compressed by the compressor 18. The compressed air from the compressor 18 is then directed into the combustor section 20 where the compressed air is mixed with fuel. The mixture of compressed air and fuel is generally burned within the combustor section 20 to generate high-temperature, high-pressure combustion gases, which are used to generate torque within the turbine 22. Specifically, the combustion gases apply motive forces to the blades 36 to rotate the wheels 38. In certain embodiments, a pressure drop may occur at each stage 34 of the turbine 22, which may allow gas leakage flow through unintended paths. For example, the hot combustion gases 40 may leak into the interstage volume between turbine wheels 38, normally reserved for the cooling fluid 46. This type of leakage may place thermal stresses on the turbine components. Furthermore, flow of hot combustion gases 40 into the interstage volume may abate the cooling effects of the cooling fluid 46. Accordingly, the seal assemblies 44 may be disposed between adjacent wheels 38 to seal and enclose the interstage volume from the hot combustion gases 40.

Figure 3:
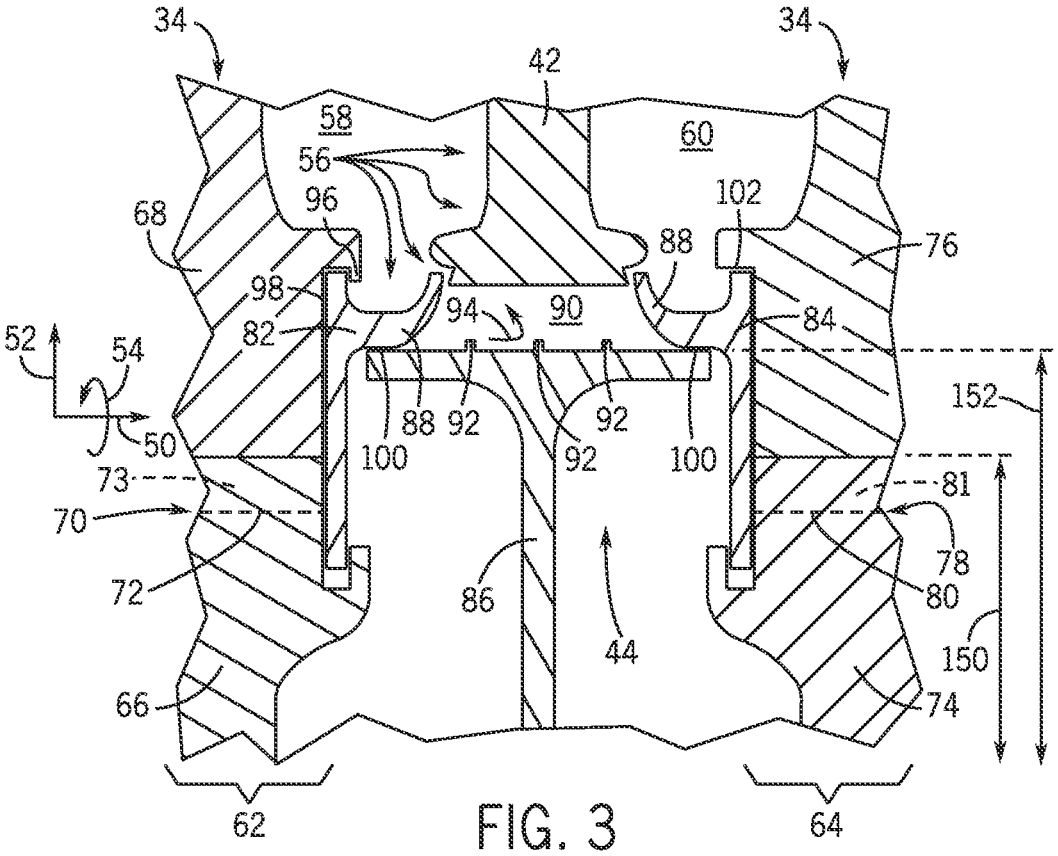
FIG. 3 is a partial cross-sectional side view of the gas turbine engine of FIG. 2 illustrating an embodiment of a seal assembly between turbine stages.

FIG. 3 is a partial cross-sectional side view of the gas turbine engine of FIG. 2 illustrating an embodiment of the seal assembly 44 between turbine stages 34. In the following discussion, reference may be made to an axial direction or axis 50, a radial direction or axis 52, and a circumferential direction or axis 54, relative to the longitudinal axis 32 of the gas turbine engine 12. Hot fluids, such as hot combustion gases 40 or steam, with a flow path 56 (illustrated generally by arrows) enters at an upstream side 58 and exits at a downstream side 60. For illustrative purposes, only a portion of the stages 34 are illustrated in FIG. 3. Specifically, a first turbine stage 62 is shown near the upstream side 58 and a second turbine stage 64 is shown near the downstream side 60. The first turbine stage 62 includes a first wheel 66 with a plurality of first blade segments 68 extending radially outward 52 from a first wheel post portion 70 of the first wheel 66. The first wheel post portion 70 is disposed along the circumference of the first wheel 66 and includes slots 72 (e.g., axial dovetail slots) for retaining lower segments (e.g., axial dovetail tabs 73) of the first blade segments 68. Similarly, the second turbine stage 64 includes a second wheel 74 with a plurality of second blade segments 76 extending radially outward 52 from a second wheel post portion 78 of the second wheel 74. The second wheel post portion 78 is disposed along the circumference of the second wheel 74 and includes slots 80 (e.g., axial dovetail slots) for retaining lower segments (e.g., axial dovetail tabs 81) of the plurality of second blade segments 76. In certain embodiments, approximately 50 to 150 first and second blade segments 68 and 76 may be mounted and spaced circumferentially 54 around the first and second wheels 66 and 74 and a corresponding axis of rotation (extending generally in the direction indicated by arrow 50). In further embodiments, methods other than the slots and tabs described above may be used to couple the first and second blade segments 68 and 76 to the first and second wheels 66 and 74.

The interstage seal assembly 44 includes a first coverplate 82 and a second coverplate 84. The first coverplate 82 is secured within the first turbine stage 62 while the second coverplate 84 is secured within the second turbine stage 64. A spacer wheel 86 is positioned between the first coverplate 82 and the second coverplate 84. The spacer wheel 86 may be coupled to the rotor shaft 26 and mechanically support the first and second coverplates 82 and 84. The seal assembly 44 may include a plurality of coverplates 82, 84 and spacer wheels 86, such as 2 to 100, disposed circumferentially 54 adjacent to one another to form a complete 360-degree ring about the longitudinal axis 32 of the gas turbine engine 12. The seal assembly 44 may include equal numbers of coverplates 82, 84 or may include different numbers of first coverplates 82 and second coverplates 84. Similarly, the interstage seal assembly 44 may include a different number of spacer wheels 86 than either first coverplates 82 or second coverplates 84. Each of the components (82, 84, 86) of the interstage seal assembly 44 is arcuate in the circumferential direction 54.

As illustrated, the first coverplate 82 and the second coverplate 84 may include a seal 88 that directs the combustion gases 56 away from a gap 90 between the spacer wheel 86 and the nozzle 42. During operation of the turbine 10, the stages 34 rotate in the circumferential direction 54 while the nozzles 42 remain stationary. Thus, the spacer wheel 86 and the nozzle 42 are not connected to one another, thereby creating the gap 90. Combustion gases 56 may flow through the gap 90, and more combustion gases 56 will flow through when the gap 90 is wider. Reducing the size of the gap 90, however, may take precision, and thus be labor and time intensive. Thus, it is desirable to minimize the flow of combustion gases 56 through the gap 90 in other ways. Seals 88, such as angel wings or curved wings, may be used to direct combustion gases 56 away from the gap 90, reducing the flow therethrough. As discussed below, the disclosed embodiments attach the seal 88 to the coverplates 82 and 84, rather than placing the seal (e.g., angel wing) on a component that includes the blade, thereby helping to reduce the length of the turbine 10. In particular, attaching the seal 88 to the coverplates 82 and 84 can reduce the length of the turbine 10 due to the shorter distance that the bucket uses to slide out of the wheel during removal. The gap 90 between the spacer wheel 86 and the nozzle 42 may also include seal teeth 92 to reduce the flow of combustion gases 56. The seal teeth 92 create a flow path 94 that breaks up any straight-line path that the combustion gases 56 may otherwise travel. In other words, the seal teeth 92 may create a tortuous path for the combustion gases 56.

As described in detail below, the first blade segment 68 may include a hook 96 that is configured to couple the first coverplate 82 to an inner edge 98 of the first blade segment 68. The hook 96 holds the first coverplate 82 in place during operation of the turbine 10 and during installation of the interstage seal assembly 44. The first coverplate 82 and the second coverplate 84 may also be held in place by the spacer wheel 86. In such an embodiment, the first blade segment 68 and the second blade segment 76 may hold the coverplates 82, 84 in place without a hook 96. Furthermore, in such an embodiment, the installation of the coverplates 82, 84 may vary from the procedure described below. During operation of the turbine 10, the seal assembly 44 rotates in the circumferential direction 54, which causes radial 52 forces on the spacer wheel 86. The spacer wheel 86 is thus pushed radially 52 outward and engages the coverplates 82, 84 tightly at engagement points 100. The engagement causes the coverplates 82, 84 to load into the blade segments 68, 76, such that the seal assembly 44 remains secure as it rotates with the turbine 10. The seal assembly 44, in some embodiments, may use the hook 96 only on one side of the assembly. In other words, the second blade segment 76 may not use a hook on the outer edge 102 where it meets the second coverplate 84, as shown in FIG. 3. Instead, the spacer wheel 86 may be used to hold the second coverplate 84 in place.

This configuration enables the spacer wheel 86 to engage the coverplates 82, 84 at a greater radial 52 distance than would otherwise be practical. For example, rather than engaging the coverplates 82, 84 at a radial 52 distance that is less than a radius 150 of the turbine wheel 66, 74, the spacer wheel 86 may engage at the engagement points 100 which are positioned at attachment radius 152. In the illustrated embodiment, the engagement points 100 are radially 52 outside the point where the first wheel 66 meets the first blade segment 68 and outside the point where the second wheel 74 meets the second blade segment 76. This enables a more efficient flow of combustion gases 56 and also blocks the cooling fluid 46 from entering the path of the combustion gases 56. In other embodiments where the coverplates are not present, the interstage seal may attach directly to the buckets.

Figure 4:
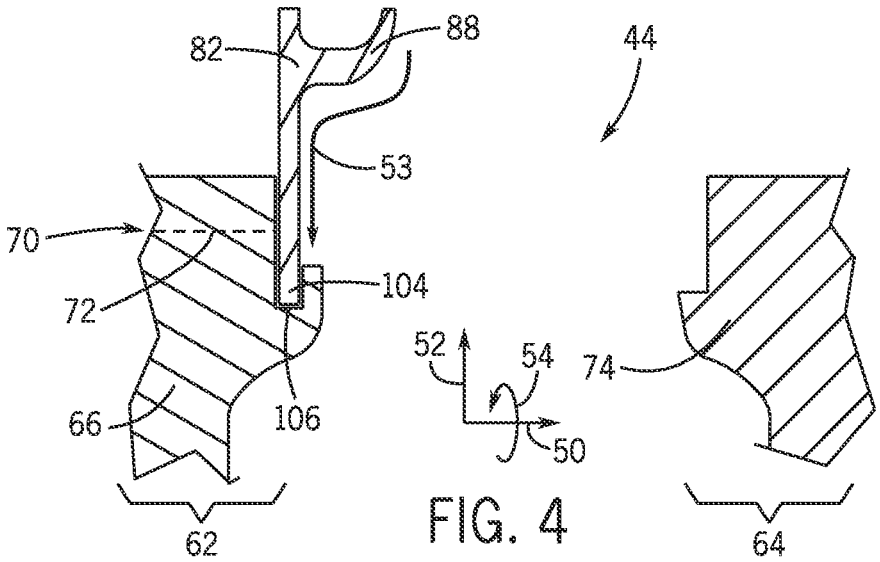
FIG. 4 is a partial cross-sectional side view of the gas turbine engine of FIG. 2 illustrating an embodiment of a seal assembly being installed between adjacent stages.

FIG. 4 is a partial cross-sectional side view of the gas turbine engine of FIG. 2 illustrating an embodiment of the seal assembly 44 being installed between adjacent stages 62. As illustrated, the first stage 62 includes the first wheel 66 without the first blade segment 68 and the second stage 64 includes the second wheel 74 without the second blade segment 76. Each blade segment 68, 76 may be removed as part of a servicing or other procedure. The slot 72 is thus empty. As part of the installation of the seal assembly 44, a lower end 104 of the first coverplate 82 is installed into a first circumferential slot 106 in a direction 53 that is opposite the radial direction 52 (i.e., toward the longitudinal axis 32). As shown, the lower end 104 is inserted completely into the bottom of the first circumferential slot 106. Thus, FIG. 4 may represent a first step in the assembly of the seal assembly 44 in the gas turbine engine 12. In other embodiments, the steps in the assembly of the seal assembly 44 may include a different first step.

Figure 5:
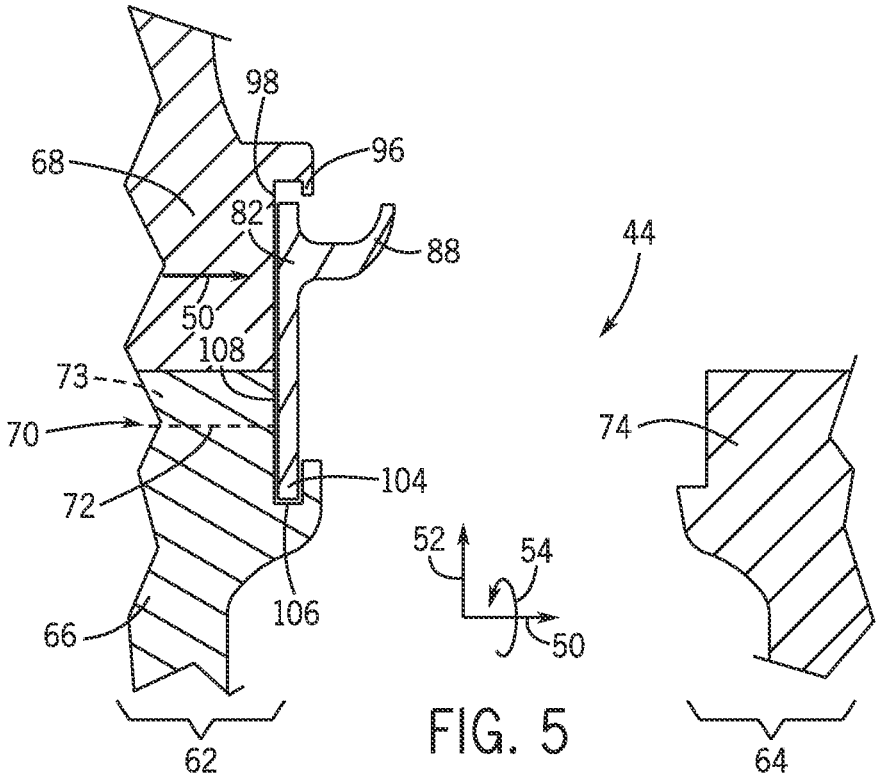
FIG. 5 is a partial cross-sectional side view of the gas turbine engine of FIG. 2 illustrating an embodiment of a seal assembly being installed between adjacent stages.

FIG. 5 is a partial cross-sectional side view of the gas turbine engine of FIG. 2 illustrating an embodiment of the seal assembly 44 being installed between adjacent stages 62 and 64. Specifically, FIG. 5 may represent a second step in the assembly of the seal assembly 44 in the gas turbine engine 12. It may be understood that the assembly of the seal assembly 44 may start with the installation of the second coverplate 84 in the second stage 64; no limitation is intended as to the order of the assembly. As shown, after the first coverplate 82 is installed in the circumferential slot 106, as shown in FIG. 4, the first blade segment 68 slides in the axial direction 50 into place around the outside of the first wheel 66. The second blade segment may also be installed using a circumferential attachment. The tab 73 is secured within the slot 72, which secures the first blade segment 68. The inner edge 98 of the first blade segment 68 is even with (e.g., adjacent to) the inner edge 108 of the first wheel 66. As explained in detail below with regard to FIGS. 8 and 9, the first coverplate 82 is configured to block cooling fluid 46 from leaking through the slot 72 around the tab 73. The hook 96 on the edge of the blade segment 68 is configured to slide over or past the top of the first coverplate 82 while the first coverplate 82 is inserted into the bottom of the circumferential slot 106. As mentioned above, the first blade segment 68 may not include a hook 96. In embodiments lacking the hook 96, the first coverplate 82 may fit snugly between the bottom of the circumferential slot 106 and the area of the first blade segment 68 where the hook 96 would normally be located. A blade segment lacking the hook 96 may be employed by either the first blade segment 68, the second blade segment 76, or both. By extension, each of the turbine stages (e.g., stages 62, 64) in the multi-stage turbine engine 12 may includes a blade segment that lacks the hook 96.

Figure 6:
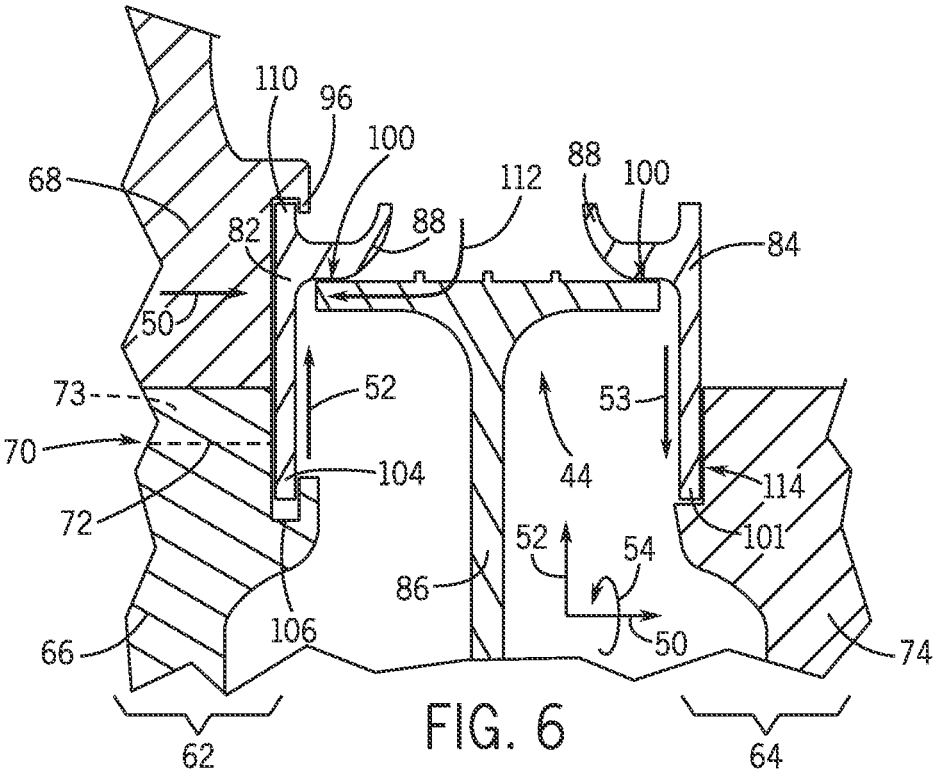
FIG. 6 is a partial cross-sectional side view of the gas turbine engine of FIG. 2 illustrating an embodiment of a seal assembly being installed between adjacent stages.

FIG. 6 is a partial cross-sectional side view of the gas turbine engine of FIG. 2 illustrating an embodiment of the seal assembly 44 being installed between adjacent stages 62. Specifically, FIG. 6 may represent a third step in the assembly of the seal assembly 44 in the gas turbine engine 12. After the first blade segment 68 is secured into place above the first wheel 66, the spacer wheel 86 and the second coverplate 84 are installed between the first stage 62 and the second stage 64. To make room for the spacer wheel 86, the first coverplate 82 is moved radially outward in the radial direction 52. The circumferential slot 106 may be deep enough that when the first coverplate 82 slides radially outward, the circumferential slot 106 maintains contact with the lower end 104 of the first coverplate 82 while the hook 96 maintains contact with an upper end 110 of the first coverplate 82. In other words, the hook 96 and the circumferential slot 106 help block axial 50 movement of the first coverplate 82 away from the first stage 62. When the first coverplate 82 is in position against the hook 96, the spacer wheel 86 is installed in a direction 112 that is first opposite the radial direction 52 and then opposite the axial direction 50. In some embodiments, the spacer wheel 86 may be a solid wheel, in which case the spacer wheel 86 may be installed before the first coverplate 82. The spacer wheel 86 may hold the first coverplate 82 outward in the radial direction 52 at the engagement point 100.

At some point during or after the installation of the spacer wheel 86, the second coverplate 84 is installed into a recess 114 of the second wheel 74 in the direction 53 opposite the radial direction 52. As illustrated, the recess 114 does not include the circumferential slot 106 shown in the first stage 62. The lack of the slot 106 may enable easier and faster installation of the second coverplate 84, may enable the turbine 10 to be constructed with less overall distance, and/or may enable the wheel 74 to be constructed with less complication and cost. The spacer wheel 86 engages the second coverplate 84 at the engagement point 100. The engagement point 100 in some embodiments may be axially 50 closer to the second coverplate 84, as opposed to axially 50 further out on the seal 88. This may further restrict the movement of the second coverplate 84, which may otherwise axially 50 pull away from the second wheel 74 at the bottom 101 of the second coverplate 84.

Figure 7:
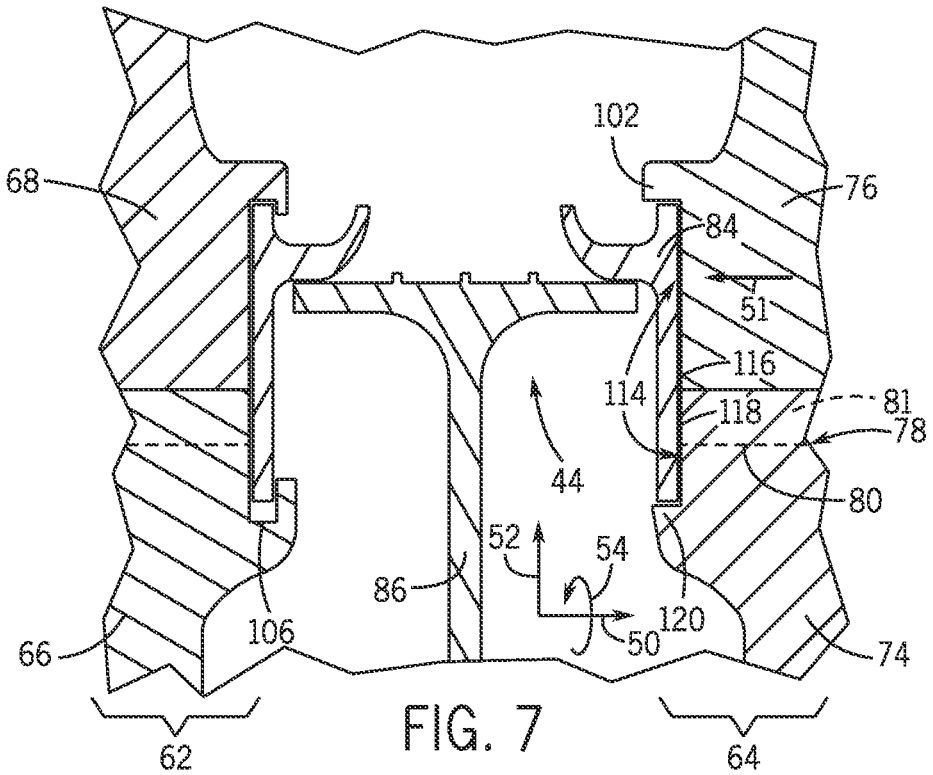
FIG. 7 is a partial cross-sectional side view of the gas turbine engine of FIG. 2 illustrating an embodiment of a seal assembly being installed between adjacent stages.

FIG. 7 is a partial cross-sectional side view of the gas turbine engine of FIG. 2 illustrating an embodiment of the seal assembly 44 being installed between adjacent stages 62. The final step in installing the interstage assembly 44 is to install the second blade segment 76 around the circumferential rim 120 of the second wheel 74. The second blade segment 76 may be installed in the direction 51 that is opposite the axial direction 50 and the dovetail tab 81 is secured within the slot 80. An inside edge 116 of the second blade segment 76 is even with an inside edge 118 of the second wheel 74, and the second coverplate 84 is flush against the inside edges 116, 118. The second coverplate 84 may fit into the recess 114 without extra space (e.g., the extra space shown in FIGS. 3, 5, and 6) on the top and bottom of the coverplate 84. In other words, the second blade segment 76 and the second wheel 74 may help block radial 52 movement of the second coverplate 84. As illustrated in FIG. 7, the second coverplate 84 may be secured and supported in the recess 114 by the spacer wheel 86. In other words, the outer edge 102 of the recess 114 may not have the hook 96 shown in the first stage 62, and the circumferential rim 120 may not have the slot 106 shown in the first stage 62. This arrangement may enable faster assembly and/or reduced cost of the turbine 10. In other embodiments, the second stage 64 may include the slot 106 and the hook 96. In still further embodiments, the first stage 62 and the second stage 64 may both lack the slot 106 and the hook 96 as illustrated by the second stage 64 in FIG. 7.

Figure 8:
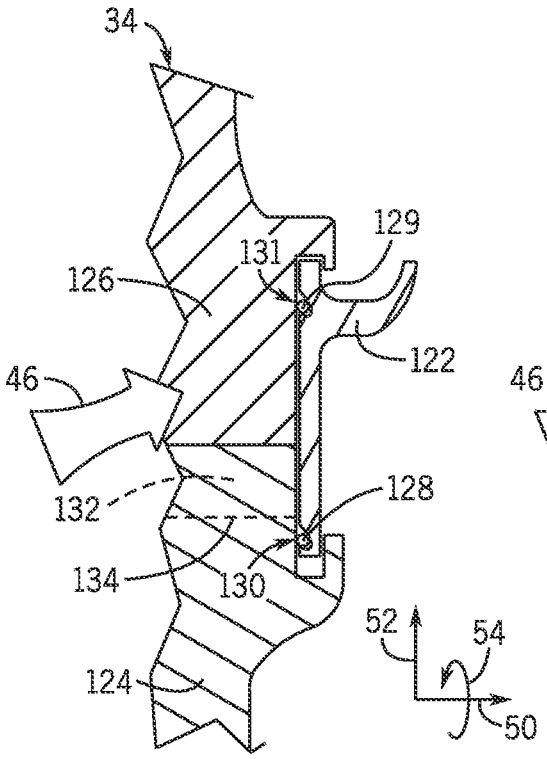
FIG. 8 is a partial cross-sectional side view of the gas turbine engine of FIG. 2 illustrating an embodiment of a coverplate having a seal structure.

FIG. 8 is a partial cross-sectional side view of the gas turbine engine of FIG. 2 illustrating an embodiment of a first or second coverplate 82, 84 having a sealing element 130, 131. FIG. 8 shows a coverplate 122 (e.g., first or second coverplate 82, 84) that may be installed into any turbine stage 34, such as the first turbine stage 62 or the second turbine stage 64 described above. The coverplate 122 is installed with a wheel 124 and a blade segment 126 that may share characteristics with, or have different characteristics, from the first wheel 66, second wheel 74, first blade segment 68, and/or second blade segment 76 described above. The coverplate 122 includes a radially 52 inner seal structure 128 and a radially 52 outer seal structure 129. Collectively, the inner seal structure 128 and the outer seal structure 129 are known as the sealing element 130, 131. The sealing element 130, 131 may be installed on the either coverplate 82, 84 of the seal assembly 44. If installed on the first coverplate, the sealing element 130, 131 may be the forward sealing element, as it is longitudinally 50 forward of the second coverplate. If installed on the second coverplate 84, the sealing element 130, 131 may be called the aft sealing element, as it is longitudinally 50 aft of the forward sealing element. The inner seal structure 128 may be disposed closer to the longitudinal axis 32 than the outer seal structure 129. The inner seal structure 128 may be disposed within an inner notch 130, which may be an indentation or other recessed portion within the coverplate 122. The inner seal structure 128 may be a metal wire coated in ceramic thermal insulation, a metal wire, or a small lip formed on the wheel 124 that is configured to fit within a notch 130 on the coverplate 122.

The sealing element 130, 131 may be configured to block the flow of cooling fluid 46 as it flows through the blade segment 126 and around the wheel 124. As explained above with regard to FIG. 2, cooling fluid 46 may flow through the turbine 10 to lower the temperature of certain components. The efficiency and/or durability of the turbine components may be adversely affected if the cooling fluid 46 escapes designated paths. For example, the cooling fluid 46 may flow around the dovetail tabs 132 that are fitted within the slots 134. To block this flow, inner seal structure 128 and/or outer seal structure 129 form a barrier around the area from which the cooling fluid 46 may flow. Installation of the sealing structures 128, 129 may occur concurrent with the installation of the coverplate 122, or they may be installed within the coverplate notches 130, 131 before the coverplate 122 is installed.

Figure 9:
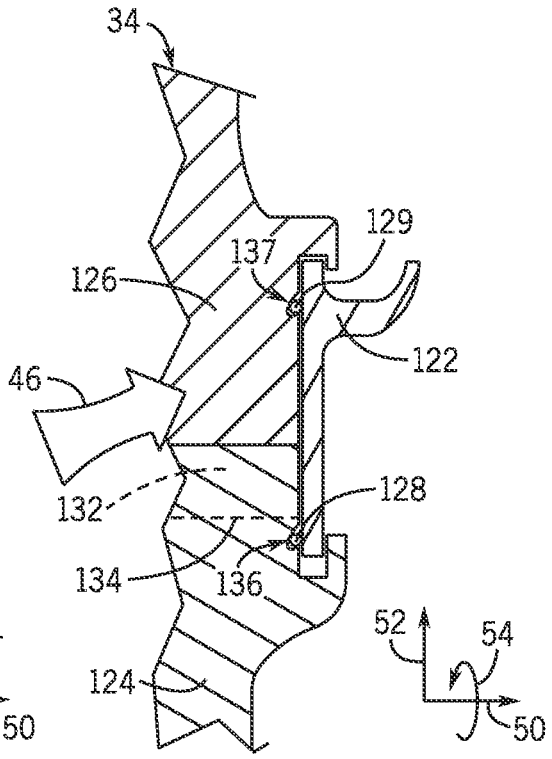
FIG. 9 is a partial cross-sectional side view of the gas turbine engine of FIG. 2 illustrating an embodiment of a coverplate having a seal structure between the coverplate and the wheel, and another seal structure between the coverplate and the blade segment.

FIG. 9 is a partial cross-sectional side view of the gas turbine engine of FIG. 2 illustrating an embodiment of a first or second coverplate 82, 84 having a seal structure 136, 137. The coverplate 122 (e.g., first or second coverplate 82, 84) in FIG. 9 may also be installed within any turbine stage 34 as part of the seal assembly 44. The coverplate 122 may also form a bather around the area from which the cooling fluid 46 may flow. The coverplate 122 in FIG. 9 illustrates that an inner notch 136 and an outer notch 137 may be formed in the wheel 124 and the blade segment 126, respectively. The inner seal structure 128 and/or outer seal structure 129 may, as described in regards to FIG. 8, form a bather around the area from which the cooling fluid 46 may flow. With the notches 136, 137 formed in the wheel 124 and blades segment, respectively, the inner seal structure 128 and the outer seal structure 129 may form a continuous circular structure even when the coverplate 122 is segmented. This may reduce the time it takes to install the seal assembly 44 by eliminating the time normally taken to install each individual seal structure 128, 129 into each individual coverplate 122. The embodiments illustrated in FIG. 8 and FIG. 9 may also be used in combination. That is, the wheel 124 may have one notch (e.g., notch 136) while the coverplate has another notch (e.g., notch 131). Also, the blade segment 126 may have one notch (e.g., notch 137) while the coverplate 122 has another notch (e.g., 130).

Figure 10:
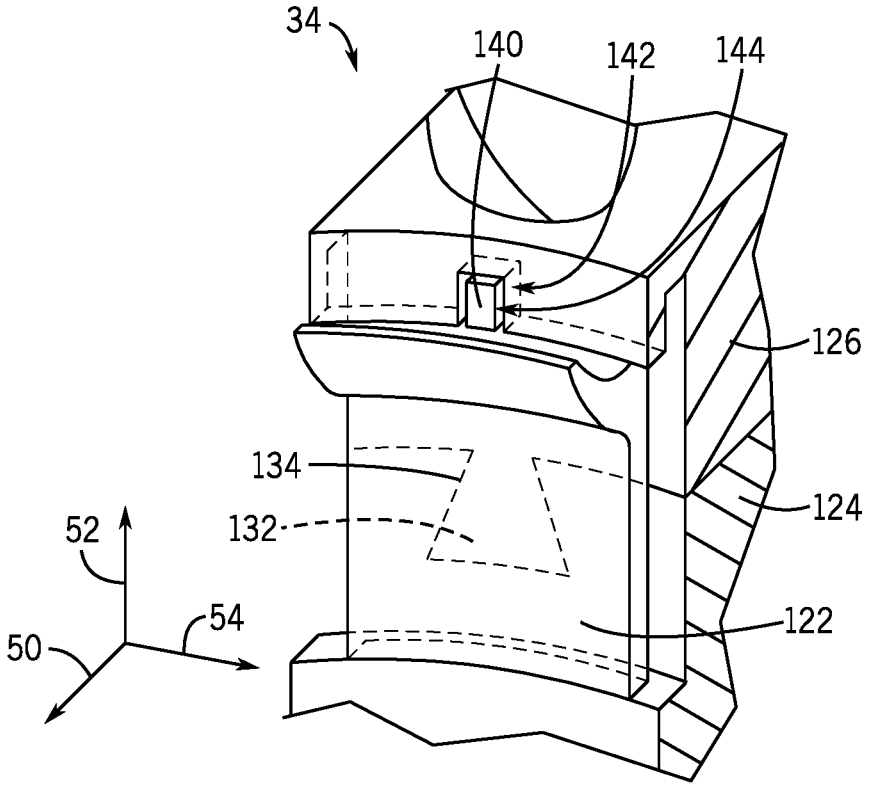
FIG. 10 is a perspective view of an embodiment of an anti-rotation tab installed in a coverplate of the gas turbine engine of FIG. 2.

FIG. 10 is a perspective view of an embodiment of an anti-rotation tab installed in a coverplate (e.g., first or second coverplate 82, 84) of the gas turbine engine of FIG. 2. The coverplate 122 in FIG. 10 may be installed in any turbine stage 34 as part of a seal assembly 44. The turbine stage 34 includes wheel 124 and blade segment 126 that are connected by the dovetail tab 132 fitted within the slot 134. The seal assembly 44 may include an anti-rotation tab 140. The anti-rotation tab 140 may be disposed within a first anti-rotation slot 142 through the front of the blade segment 126, or may be disposed within a second anti-rotation slot 144. The first anti-rotation slot 142 may extend partially into, or wholly through the blade segment 126. The second anti-rotation slot 144 may extend partially into, or wholly through the coverplate 122. The anti-rotation tab 140 may also be integral with the coverplate 122.

The anti-rotation tab 140 is configured to circumferentially 54 block movement of the coverplate 122 with respect to the wheel 124 and the blade segment 126. It will be understood that all pieces of the seal assembly 44 (wheel 124, blade segment 126, coverplate 122, and anti-rotation tab 140) rotate in the circumferential direction 54 (or in the opposite direction), but the anti-rotation tab 140 is configured such that the seal assembly 44 rotates together. The anti-rotation tab 140 may be installed with the blade segment 126 as illustrated in FIG. 5 or FIG. 7, or may be installed at any time during the installation of the seal assembly 44.

The disclosed embodiments may be beneficial in that they may be used to increase cooling efficiency by reducing leakage of cooling fluid 46 from cooling passages within gas turbines 10 while also reducing overall costs of gas turbines 10. For example, the interstage seal assembly 44 may include coverplates 82, 84, 122 that may be employed to improve separation of the cooling fluid 46 from the combustion gases 56. The spacer wheel 86 may also direct the combustion gases 56 through the turbine blades 36 and the nozzles 42 which decreases extraneous flow and thus increases efficiency of the gas turbine 10. Furthermore, the disclosed embodiments include seals 88 that are attached to the coverplates 82, 84, 122 instead of the blade segments 68, 76, which may enable a decrease in the distance between stages 34 in the turbine 10. This decrease in distance translates into an overall shortening of the gas turbine 10 and corresponding decrease in cost.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a multi-stage turbine, comprising:

a first turbine stage comprising a first wheel having a plurality of first blade segments spaced circumferentially about the first wheel;

a second turbine stage comprising a second wheel having a plurality of second blade segments spaced circumferentially about the second wheel; and an interstage seal assembly extending axially between the first and second turbine stages, comprising:

a first coverplate coupled to the first turbine stage, wherein the first coverplate comprises a first seal wing;

a second coverplate coupled to the second turbine stage, wherein the second coverplate comprises a second seal wing; and a spacer wheel extending from a rotor shaft and configured to engage with the first coverplate and the second coverplate, wherein the spacer wheel comprises a first radial engagement consisting of contact between a first radially outer surface of the spacer wheel and a first radially inner surface of the first coverplate and a second radial engagement consisting of contact between a second radially outer surface of the spacer wheel and a second radially inner surface of the second coverplate, wherein the first radial engagement occurs at the first seal wing of the first coverplate and the second radial engagement occurs at the second seal wing of the second coverplate.

2. The system of claim 1, wherein at least one of the first blade segments comprises a hook configured to couple the first coverplate to an inner edge of the first blade segment.

3. The system of claim 1, wherein the spacer wheel is configured to maintain the second coverplate coupled to the second turbine stage.

4. The system of claim 1, comprising a forward sealing element configured to block a flow of gases between the first coverplate and at least one of the first blade segments, or the first wheel, or any combination thereof.

5. The system of claim 4, wherein the forward sealing element is disposed in a first notch formed in at least one of the first coverplate, the first blade segments, or the first wheel, or any combination thereof.

6. The system of claim 1, comprising an aft sealing element configured to block a flow of gases between the second coverplate and at least one of the second blade segments, or the second wheel, or any combination thereof.

7. The system of claim 6, wherein the aft sealing element is disposed in a second notch formed in at least one of the second coverplate, the second blade segments, or the second wheel, or any combination thereof.

8. The system of claim 1, wherein the interstage seal assembly comprises an anti-rotation tab configured to restrict circumferential movement of at least one of the first coverplate with respect to the first turbine stage, the second coverplate with respect to the second turbine stage, or any combination thereof.

9. The system of claim 1, comprising one or more seal teeth attached to the spacer wheel, wherein the one or more seal teeth are configured to block interstage axial leakage between the first turbine stage and the second turbine stage.

10. The system of claim 1, comprising a nozzle disposed between the first turbine stage and the second turbine stage.

11. The system of claim 1, wherein the spacer wheel is configured to engage with the first coverplate and the second coverplate at a radial engagement distance that is greater than a radius of the first wheel, the second wheel, or any combination thereof.

12. The system of claim 1, comprising cooling passages configured to direct a cooling fluid through the first turbine stage, the second turbine stage, or any combination thereof, wherein the first coverplate, the second coverplate, or any combination thereof, are configured to block the cooling fluid from escaping the cooling passages.

13. The system of claim 1, wherein the first coverplate is disposed in a first circumferential slot formed in the first wheel and each blade segment of the first plurality of blade segments, and the second coverplate is disposed in a second circumferential slot formed in the second wheel and each blade segment of the second plurality of blade segments.

14. The system of claim 1, wherein the first seal wing is disposed at a first radial seal distance that is greater than an outermost radial wheel distance of the spacer wheel, and the second seal wing is disposed at a second radial seal distance that is greater than the outermost radial wheel distance of the spacer wheel.

15. The interstage seal assembly of claim 1, wherein the spacer wheel comprises a solid having the first radially outer surface engaged with the first radially inner surface of the first coverplate and the second radially outer surface engaged with the second radially inner surface of the second coverplate.

16. The system of claim 1, comprising a radial gap disposed between the spacer wheel and a nozzle, wherein the radial gap is configured to flow hot combustion gases therethrough.

17. A method of installing an interstage seal assembly between a first turbine stage and a second turbine stage of a multi-stage turbine, comprising:

installing a first coverplate into a first wheel of the first turbine stage;

installing a first blade segment around a first circumferential rim of the first wheel after installing the first coverplate into the first wheel, wherein the first blade segment is configured to secure the first coverplate;

installing a spacer wheel and a second coverplate, after installing the first coverplate into the first wheel, wherein the spacer wheel is installed between the first coverplate and the second coverplate and is configured to support the first coverplate and the second coverplate;

installing a second blade segment around a second circumferential rim of the second wheel, after installing the spacer wheel and the second coverplate between the first coverplate and the second coverplate.

18. The method of claim 17, comprising installing a plurality of interstage seal assemblies circumferentially about the first turbine stage and the second turbine stage.

19. The method of claim 17, comprising installing a sealing element, wherein the sealing element is configured to block a flow of gases between the first coverplate and at least one of the first blade segment, the first wheel, or any combination thereof and/or block the flow of gases between the second coverplate and at least one of the second blade segment, the second wheel, or any combination thereof.

20. The method of claim 17, comprising engaging a radially outer surface of a solid piece of the spacer wheel with a first radially inner surface of the first coverplate and a second radially inner surface of the second coverplate.

21. An interstage seal assembly for a gas turbine, comprising:

a first coverplate configured to be coupled to a first turbine stage of a multi-stage turbine, wherein the first coverplate comprises a first seal wing;

a second coverplate configured to be coupled to a second turbine stage of the multi-stage turbine, wherein the second coverplate comprises a second seal wing; and a spacer wheel configured to extend from a rotor shaft of the multi-stage turbine, wherein the spacer wheel comprises a radially outer surface, wherein the radially outer surface is configured to engage with the first coverplate at a first radial engagement at the first seal wing of the first coverplate and to engage with the second coverplate at a second radial engagement at the second seal wing of the second coverplate.

22. The interstage seal assembly of claim 21, comprising one or more seal teeth attached to the spacer wheel and configured to extend into a radial gap disposed between the spacer wheel and a nozzle, wherein the seal teeth are configured to block interstage axial leakage between the first turbine stage and the second turbine stage.

23. The interstage seal assembly of claim 21, wherein the first seal wing, the second seal wing, or combination thereof, comprises a curved wing configured to extend radially away from the spacer wheel.

24. The interstage seal assembly of claim 21, wherein the spacer wheel comprises the first radial engagement consisting of contact between a first portion of the radially outer surface of the spacer wheel and a first radially inner surface of the first coverplate and the second radial engagement consisting of contact between a second portion of the radially outer surface of the spacer wheel and a second radially inner surface of the second coverplate.

* * * * *